US006494560B1

(12) United States Patent
Seshimo et al.

(10) Patent No.: US 6,494,560 B1
(45) Date of Patent: Dec. 17, 2002

(54) INK JET PRINTER AND PRINTING SYSTEM USING THE SAME

(75) Inventors: Tatsuya Seshimo, Nagano (JP); Hikonosuke Uwai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/239,319

(22) Filed: Jan. 29, 1999

(30) Foreign Application Priority Data

Jan. 30, 1998 (JP) ..... 10-018657
Nov. 30, 1998 (JP) ..... 10-339052

(51) Int. Cl.[7] ..... B41J 2/165
(52) U.S. Cl. ..... 347/23; 347/29; 347/30
(58) Field of Search ..... 347/30, 29, 24, 347/23, 43

(56) References Cited

U.S. PATENT DOCUMENTS

| | | | | |
|---|---|---|---|---|
| 4,878,063 A | * | 10/1989 | Katerberg | 346/46 |
| 4,908,638 A | * | 3/1990 | Albosta et al. | 347/22 |
| 4,977,459 A | * | 12/1990 | Ebinuma et al. | 346/33 A |
| 5,068,806 A | * | 11/1991 | Gatten | 347/7 |
| 5,504,508 A | | 4/1996 | Hashimoto | 347/24 |
| 5,625,385 A | * | 4/1997 | Suzuki | 347/24 |

FOREIGN PATENT DOCUMENTS

| | | | | |
|---|---|---|---|---|
| EP | 318329 | | 5/1989 | |
| EP | 380056 | | 8/1990 | |
| EP | 447262 | | 9/1991 | |
| EP | 630754 | | 12/1994 | |
| EP | 631871 | | 1/1995 | |
| JP | 7-171975 A | * | 7/1995 | B41J/2/165 |
| JP | 2700341 | | 10/1997 | B41J/2/175 |
| JP | 2718724 | | 11/1997 | B41J/2/165 |
| JP | 10-181040 A | * | 7/1998 | B41J/2/165 |

* cited by examiner

*Primary Examiner*—John S. Hilten
*Assistant Examiner*—Shih-wen Hsieh
(74) *Attorney, Agent, or Firm*—Sughrue Mion, PLLC

(57) ABSTRACT

When ink is sucked from the nozzles during a cleaning process, a rubber cap having a plural number of small spaces independently operable for ink suction is applied to a print head, and only the small space associated with a clogged nozzle of those nozzles of the print head is connected to a suction pump. A user looks up in advance the number and location of a clogged nozzle, judges the cause of the clogging of the nozzle on the basis of the number and location of the clogged nozzle, and selects a suitable type of cleaning process, a selective cleaning (based on the specified-nozzle suction) or a conventional cleaning (based on the all-nozzle suction).

7 Claims, 15 Drawing Sheets

FIG. 10
| NUMBER \ LOCATION | | END | CENTER |
|---|---|---|---|
| ONE NOZZLE | | B | B |
| PLURAL NOZZLES | 2 | A | B |
| | 3 OR LARGER | A | A |
FIG. 11
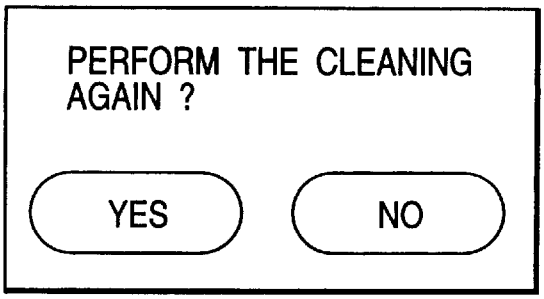
FIG. 12A
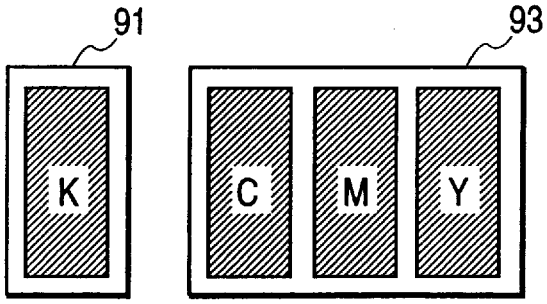
FIG. 12B
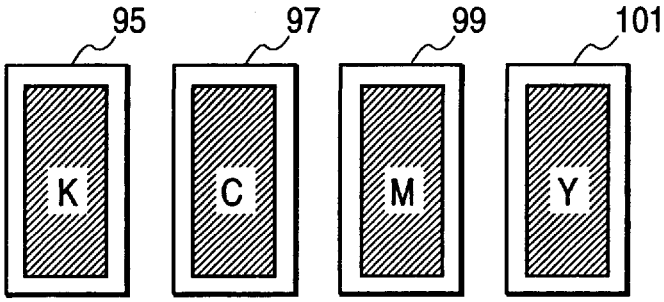

INK JET PRINTER AND PRINTING SYSTEM USING THE SAME

BACKGROUND OF THE INVENTION

1. Field of the Invention

The present invention relates to the structure for cleaning a print head of an ink jet printer and a device for driving the cleaning structure.

The present invention is based on Japanese Patent Applications No. Hei. 10-18657 and Hei. 10-339052, which are incorporated herein by reference.

2. Description of the Related Art

In the ink jet printer, liquid ink is supplied from an ink tank to a print head, and forcibly discharged in the form of an ink droplet onto a printing medium, through ink jet nozzles of the print head. Sometimes, one of some of the ink passages ranging from the ink tank to the ink jet nozzles are clogged with air bubbles to possibly obstruct the ink discharging through the passage. To cope with this, the ink jet printer usually has a "clogging-check-pattern printing function", and a "cleaning function". When the former function is exercised, the printer prints a preset clogging check pattern by use of all the nozzles of the print head. A user checks the printed preset pattern to locate a clogged nozzle or nozzles if such defective nozzle is present. The latter function, or the cleaning function, is exercised when the clogged nozzle is located, to suck ink from the clogged nozzle to remove its clogging.

Most of the ink jet printers are designed so as to be capable of printing in monocolor or multi-color mode. To this end, the printer uses four (K (black), C (cyan), M (magenta), Y (yellow)) or larger number of color inks. Further, the printer includes ink tanks and a set of nozzles (e.g., 64 or 128 nozzles), which are respectively provided for those color inks. In a printer using four color inks and having 64 nozzles for each color, the total number of required nozzles is 256, and greater.

The clogging check pattern printed out shows the location of a clogged nozzle, if present. Therefore, the user knows which of those nozzles arrayed is clogged. In the event that at least one nozzle is clogged, the user instructs the printer to exercise the cleaning function for removing the clogging. The cleaning operation usually consists of three steps; 1) "flushing" for driving the nozzle to discharge the ink, 2) "wiping" for wiping out the ink from the nozzle surface, and 3) "suction" for sucking the ink from the nozzles by applying negative pressure to the nozzle. Thus, the cleaning operation is complicated. Of those cleaning operation steps, the "suction" process is performed such that 1) the print head is moved to a home position, 2) the entire print surface of the print head is capped with a rubber cap, and 3) the ink is sucked from all the nozzles of the print head thus capped.

As described above, in the event of clogging of the nozzle, to remove the clogging, all the nozzles must be subjected to the suction process although the clogged nozzle is located. Some reasons are present for this. One of the reasons follows. The capping is formed through a complicated mechanism. Therefore, if only the clogged nozzle is sucked, the clogging is not always removed. If so, a natural conclusion is that the sucking of all the nozzles will reliably remove the clogging of the nozzle. However, the sucking of all the nozzles leads to consumption of much ink. The cost of the ink consumption is for the user to bear.

Some places where air bubbles are likely to stay are present in the ink passage ranging from the ink tank to the ink jet nozzle. One of the places is a filter chamber located downstream of and near to the ink tank. In case where a replaceable, ink cartridge is used for the ink tanks, the filter chambers are provided with needle tubes. When the ink cartridge is set to the printer, the needle tubes are thrust into the related ink tanks. During the thrusting, air bubbles possibly enter the filter chamber through a cylinder-piston action by the ink tank and the needle tube.

Generally, one ink tank supplies ink to a number of ink jet nozzles, and an ink supply passage is branched at a location downstream of the filter chamber to have a number of ink passages. The branching of the ink supply passage leads to an increase of its cross section area. The result is that an ink flow rate in each branched ink passage is reduced, and the force acting to drive the air bubbles out of the filter chamber is weak or insufficient.

SUMMARY OF THE INVENTION

Accordingly, an object of the present invention is to minimize the amount of ink consumed by the process of cleaning the ink jet nozzles.

Another object of the invention is to effectively drive air bubbles out of the filter chamber through the branched ink supply passages.

According to one aspect, there is provided an ink jet printer comprising: at least one ink chamber; a print head having a plurality of ink jet nozzles and being connected to the ink chamber; a print controller for driving the print head in order to print; and a capping device for covering the ink jet nozzles of the print head.

The capping device comprises: a cap component having a plurality of cavities for sorting the ink jet nozzles into a plurality of nozzle groups by ink chamber unit, thereby capping all ink jet nozzles corresponding to at least one ink chamber by nozzle group unit; at least one pipe being connected to the cavities of the cap component for supplying negative pressure to the cavities; and a suction controller for controlling the supply of the negative pressure through the pipe to the cavities, thereby supplying the negative pressure independently by every cavity, whereby the suction controller sucks the ink from the ink jet nozzles independently by the nozzle group unit.

In a preferred embodiment of the ink jet printer, the suction controller supplies the negative pressure to one arbitrary cavity of the cap component so as to suck the ink from the ink jet nozzles independently by the nozzle group unit, and all remaining cavities which correspond to one common ink chamber with the arbitrary cavity are sealed.

In another embodiment, the suction controller supplies the negative pressure to all the cavities corresponding to one common ink chamber simultaneously.

In yet another embodiment, a plurality of the ink chambers are provided in the printer, and the cap component has a dimension and number of cavities for capping all of the ink jet nozzles connected to all ink chambers.

In still another embodiment, the cap component comprises one of an integral unit and a plurality of sub-units divided according to the nozzle groups sorted by the ink chamber unit.

In a further embodiment, a plurality of the ink chambers are provided in the printer, and the cap component does not have a dimension and number of cavities for capping all of the ink jet nozzles connected to all ink chambers, and the ink jet printer further comprising a second cap component capping all of the ink jet nozzles at a stretch.

In a still further embodiment, a plurality of the nozzle groups are arranged in a recording medium transporting direction.

In another embodiment, the cap component includes the number of chambers equal to that of the nozzle groups, and caps all the nozzle groups of the print head simultaneously.

In yet another embodiment, one nozzle group is divided into at least two sub-groups of nozzle (in an extreme case, one sub-group consists of one nozzle), and the cap component includes at least two cavities and simultaneously caps those sub-groups.

In still another embodiment, pipes connected to the cavities include valves for closing and opening the pipes. By selectively opening the valves, ink is selectively sucked from the nozzle groups.

In a further embodiment, the pipes connected to the cavities include negative pressure sources, independently operable.

In an additional embodiment, two or larger number of the nozzle groups of the print head are connected to one ink chamber. The cap component includes two or larger number of the cavities so as to simultaneously cap two or larger number of the nozzle groups connected to one ink chamber. Negative pressure is selectively supplied to those cavities. At this time, the remaining cavities are closed (by closing the valves of the pipes associated therewith or applying low negative pressure thereto), thereby preventing air bubbles from entering the remaining nozzle groups.

In another embodiment of the ink jet printer, at least two nozzle groups of the print head are connected to one chamber, and ink is sucked from the two or larger number of nozzle groups connected to the chamber.

In an additional embodiment, the suction controller includes a selective suction portion for supplying negative pressure to one cavity selected from the cavities, and an all-nozzle suction portion for supplying negative pressure to all of the cavities.

In another embodiment, the suction controller includes a selective suction portion for supplying negative pressure to one cavity selected from the plural number of cavities so as to suck ink from the selected cavity, and an all-nozzle suction portion for supplying negative pressure to all of the cavities so as to suck ink from all of the cavities.

In yet another embodiment, the suction controller controls the supply of negative pressure in accordance with clogged nozzle information indicative of a location of a clogged nozzle.

In still another embodiment, the clogged nozzle information includes information indicative of the ink chamber connected to a clogged nozzle, the number of clogged nozzles, and a location of the clogged nozzle on the print head.

In an additional embodiment of the ink jet printer, the suction controller includes a selection table containing a plural number of control guidance corresponding to a variety of clogged nozzle information, and controls the supply of negative pressure in accordance with a specific control guidance, which correspond to the clogged nozzle information, selected from the selection table.

In a further embodiment, the suction controller selects a selective suction mode or an all-nozzle suction mode in accordance with the clogged nozzle information received, and when the selective suction mode is selected, the suction controller sucks ink from at least one nozzle group selected from the plural number of nozzle groups, and when the all-nozzle suction mode is selected, the suction controller simultaneously sucks ink from all of the nozzle groups.

Further, the print controller may include a check pattern print portion for printing a predetermined clogging check pattern used for locating a clogged nozzle by driving the print head.

The ink jet printer may further comprises pattern reading means for reading a printed clogging check pattern to locate a clogged nozzle and to send resultant clogged nozzle information to the suction controller.

The ink jet printer may further comprise input means, operated by a user, for entering clogged nozzle information to the ink jet printer.

In a further embodiment, the ink jet printer is connected to a host controlling device, and the suction controller receives clogged nozzle information from the host controlling device.

In the ink jet printer, the suction controller receives information designating a specific nozzle group or a specific chamber, and supplies negative pressure to a chamber associated with the specific nozzle group or the specific chamber in accordance with the designating information.

The ink jet printer is connected to a host controlling device, and the suction controller receives the designating information from the host controlling device.

According to another aspect of the invention, there is provided a printing system including an ink jet printer and a host controlling device for controlling the ink jet printer. The ink jet printer is constructed described above, and sucks ink from the nozzles of the print head every nozzle group. The host controlling device sends to the ink jet printer selection information necessary for selecting a nozzle group to be sucked from the nozzle groups.

In a preferred embodiment of the printing system, the host controlling device includes a commanding portion for commanding the ink jet printer to print a predetermined clogging check pattern, a user input means by which a user enters user input information indicative of clogged nozzle information, and a selection information generator for generating the selection information on the basis of the user input information entered by the user interface.

In another embodiment of the printing system, the user interface displays a clogging check pattern image on a user interface screen of the host controlling device, and the user enters the user input information by pointing a location on the displayed clogging check pattern image, which corresponds to the location of the clogged nozzle.

According to a further aspect of the invention, there is provided a data storing medium, accessible by a computer, storing a program for executing a process to detect a defective dot forming element of those dot forming elements in a printer, wherein the process comprising the steps of: instructing the printer to print a predetermined clogging check pattern; displaying a clogging check pattern image on a user interface screen of the computer; and specifying the defective dot forming element in a manner that the user points to a location in the displayed clogging check pattern, which corresponds to the defective dot forming element.

According to an additional aspect of the invention, there is provided a data storing medium, accessible by a computer, storing a program for executing a process to instruct an ink jet printer having a number of ink jet nozzles to clean the nozzles, wherein the ink jet printer selectively performs an ink saving cleaning process or a normal cleaning process, the ink saving cleaning process is executed through a selective suction operation to suck ink from only at least one nozzle selected from the ink jet nozzles at any time, and the normal cleaning process is executed through a all-nozzle suction operation for simultaneously sucking ink from all of the ink jet nozzles, and the cleaning instruction process includes a step of displaying an image requesting a user to select the ink saving cleaning process or the normal cleaning process on a user interface screen of the computer, a step of instructing the ink jet printer to execute the ink saving cleaning process or the normal cleaning process selected, by the user, on the user interface screen of the computer.

According to an additional aspect of the invention, there is provided a control method for an ink jet printer having a print head having a number of ink jet nozzles sorted into a plural number of nozzle groups, and a capping device for selectively sucking ink from the nozzle groups by selectively capping the nozzle groups, comprising the steps of: printing a predetermined clogging check pattern and causing a user to locate a clogged nozzle or nozzles; visually presenting a clogging check pattern to the user; obtaining information indicative of the clogged nozzle in a manner that the user points to a location in the displayed clogging check pattern, which corresponds to the clogged nozzle in the printed clogging check pattern; selecting one nozzle group from the nozzle groups on the basis of the clogged nozzle information obtained; and sucking ink from the selected nozzle group.

As well known, a computer program implementing the present invention may be installed in or loaded into the computer by any of various media, e.g., the disk storage, the semiconductor memory, and the communication line.

Features and advantages of the invention will be evident from the following detailed description of the preferred embodiments described in conjunction with the attached drawings.

BRIEF DESCRIPTION OF THE DRAWINGS

In the accompanying drawings:

FIG. 8A shows a check pattern showing no clogged nozzle, and FIG. 8B shows a check pattern having clogged nozzles;

FIG. 10 is a table showing a logic to determine a type of cleaning process;

FIG. 11 is a diagram showing a display screen for user interface, different from the display screen of FIG. 10;

FIGS. 12A and 12B are diagrams showing variations of the head structure;

DETAILED DESCRIPTION OF THE PREFERRED EMBODIMENTS

Figure 1:
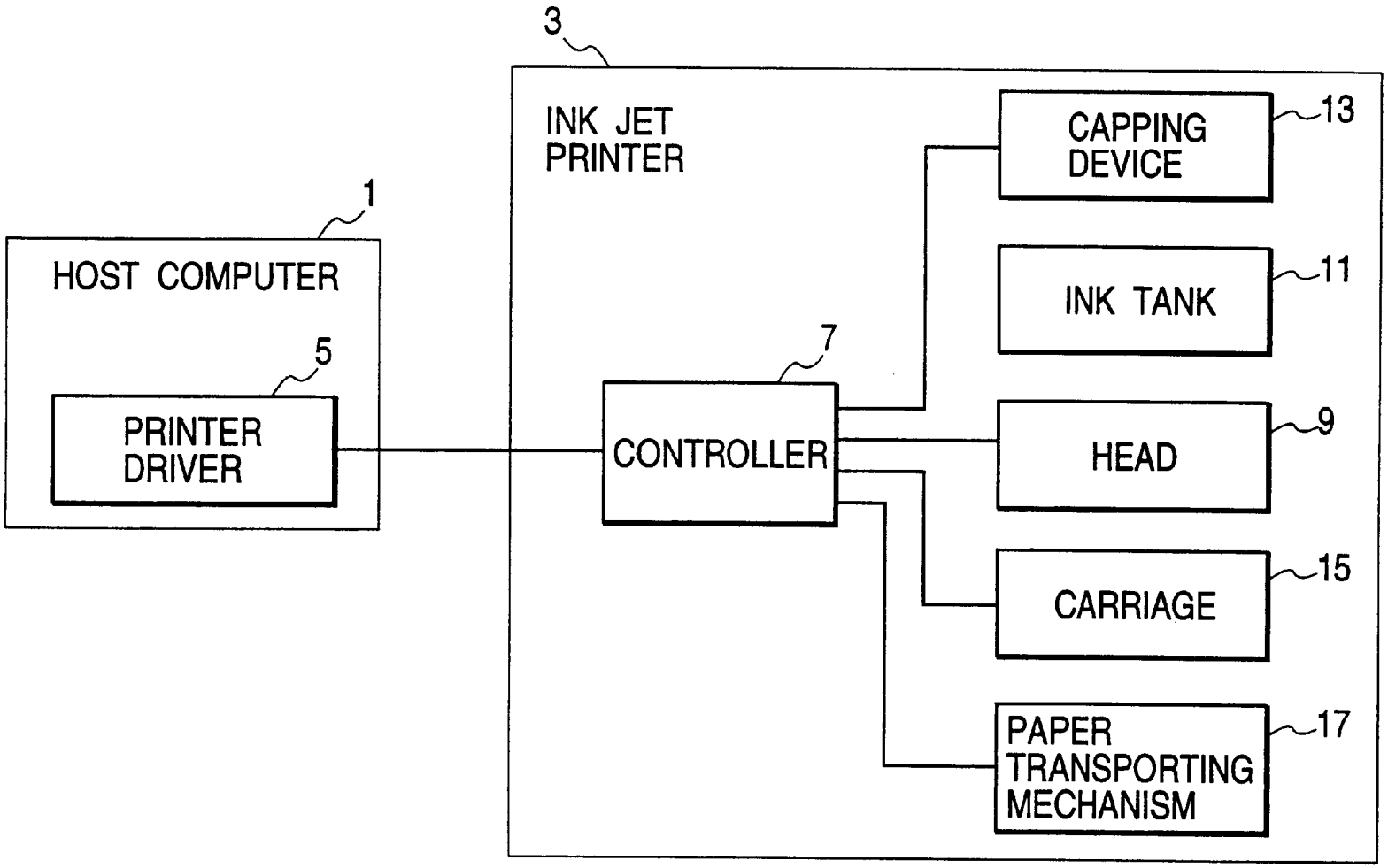
FIG. 1 is a block diagram showing an overall print system which is an embodiment of the present invention.

FIG. 1 is a block diagram showing an overall print system which is an embodiment of the present invention.

As shown, an ink jet printer 3 is connected to a host computer 1, through a local printer cable or a communication network. The host computer 1 contains a printer driver 5 as a software for sending to the printer 3 commands that instruct the printer 3 to execute a print process and a cleaning process. The printer 3 includes a controller 7, a print head 9, an ink tank 11, a capping device 13, a carriage mechanism 15, a paper transporting mechanism 17. The controller 7 receives commands from the printer driver 5, interprets the commands, and controls the above-mentioned portions, devices and mechanism of the printer. The print head 9 includes a number of ink jet nozzles. The capping device 13 includes a rubber cap applied to the print head 9, a pump for sucking ink from the print head 9, and the like. The carriage 15 provides a path along which the print head 9 runs. The paper transporting mechanism 17 transports a printing medium or paper.

For the cleaning of the ink jet nozzles to which the invention is directed, the printer driver 5 has 1) a function to send to the printer 3 a command to print a "clogging check pattern" to check whether or not a clogged nozzle or nozzles are contained in the print head 9, 2) another function to select a nozzle group of the print head 9 to be subjected to a cleaning process on the basis of the result of printing the clogging check pattern, and 3) yet another function to send to the printer 3 a command to clean the selected nozzle group, and 4) other functions. The capping device 13 of the printer 3 is operable in either of the following two modes for performing the "suction" step of the cleaning process; in a first mode, the capping device sucks the nozzles for each group of nozzles arrayed on the print head 9, and in a second mode, it sucks all the nozzles at a stretch. The controller 7 of the printer 3 has at least two functions. A first function is exercised when the controller 7 receives a print command to print a clogging check pattern from the printer driver 5; in response to the print command, the controller 7 drives the print head 9, the carriage mechanism 15 and the paper transporting mechanism 17 to print out the clogging check pattern on a printing paper. A second function is exercised when the controller 7, acting as a section controller, receives a cleaning command from the printer driver 5; in response to the print command, the controller 7 drives the print head 9, the carriage mechanism 15 and the capping device 13 to perform the cleaning process.

Figure 2:
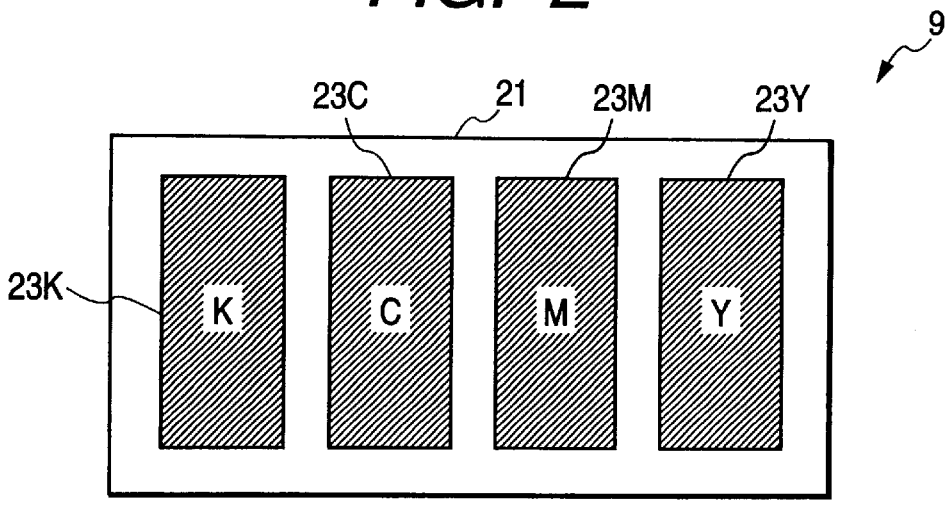
FIG. 2 is a front view schematically showing a print surface (facing a printing medium) of a print head.
Figure 3:
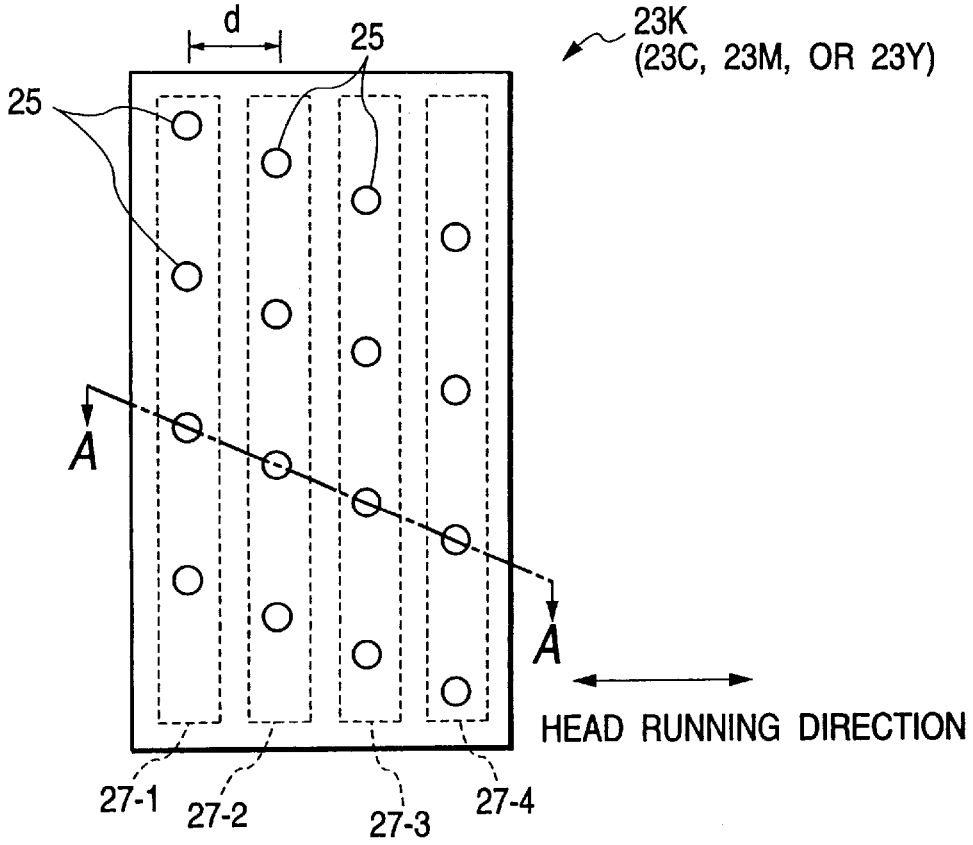
FIG. 3 is a front view showing a nozzle array for one color.

FIG. 2 is a front view schematically showing a print surface (facing a printing medium) of the print head 9. As shown, the print surface of the print head 9 includes a sheet of head plate 21 in the embodiment under discussion. Four large nozzle orifice groups 23K, 23C, 23M and 23Y for discharging four color inks of K, C, M and Y are formed in the head plate 21 while being arranged as shown. To be more specific, as shown in FIG. 3, a large nozzle orifice group 23 for each color has sixteen nozzle orifices 25. Those sixteen nozzle orifices are arranged into four linear nozzle arrays 27-1 to 27-4. One linear nozzle array 27 corresponds to one nozzle group unit in this embodiment. The head configuration and the nozzle orifice arrangement, which are actually employed by the printers, come in many varieties. In recent printers, six or seven color inks are used, and the number of nozzles per color is great, for example, 32, 64 or 128. In the embodiment description to follow, the head configuration and the nozzle (or orifice) arrangement, which are shown in FIGS. 2 and 3, are employed for simplicity of explanation.

Figure 4:
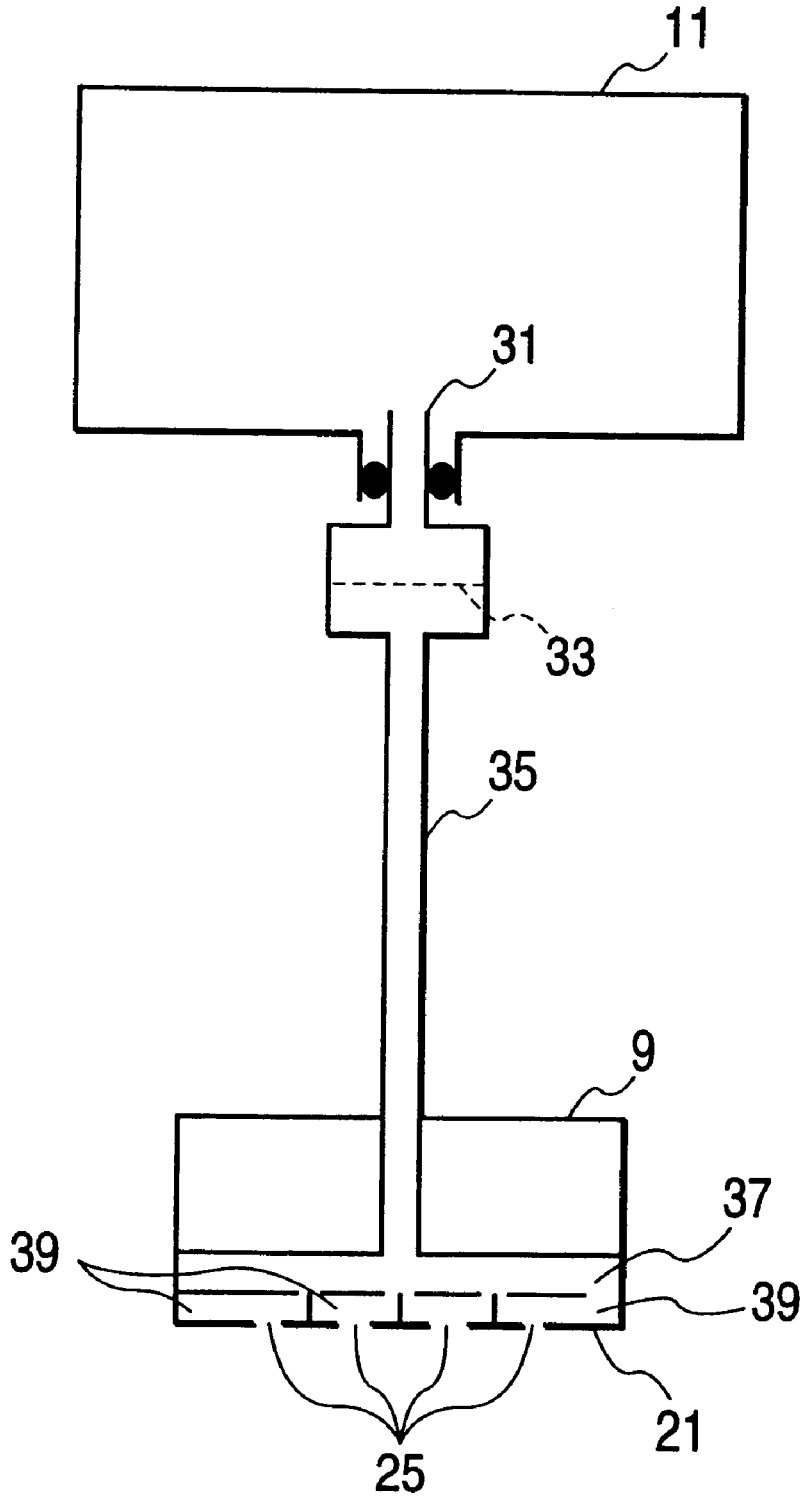
FIG. 4 is a cross sectional view schematically showing an ink passage ranging from an ink tank to the print head.

FIG. 4 is a cross sectional view schematically showing an ink passage for one color ink, which ranges from the ink tank 11 to the print head 9.

As shown, a needle tube 31 is thrust into the ink tank 11, and ink is fed from the needle tube 31 to the print head 9, through a feed pipe 35. A filter 33 is provided at the base part of the needle tube 31. The filter filters off air bubbles and dust particles that come in when the needle tube 31 is thrust into the ink tank 11. Within the print head 9, the ink is temporarily stored in a reservoir 37; the ink is fed from the reservoir 37 to cavities 39 respectively associated with the nozzles 25; and the ink is jetted out of the nozzles 25 by expansion/contraction motions of the cavities 39 caused by piezoelectric elements associated therewith.

A major cause for the nozzle clogging is that air bubbles stay in the ink passage, and block or impede the flow of ink through the ink passage. It is estimated that the places where the air bubbles are easy to stay in the ink passage are the filter 33, the feed pipe 35 and the cavities 39. When air bubbles stay in the filter 33 and/or the feedpipe 35, no ink is possibly discharged from a plural number of nozzles, particularly nozzles of relatively large flow resistance (typically, the nozzles located far from the connection part of the reservoir 37 and the feed pipe 35; for example, the nozzles located to the ends of the nozzle orifice arrays). The sucking of ink from all the nozzles (cleaning of those nozzles) will be effective for this type of the nozzle clogging. When the bubble stays in a specific cavity or cavities 39, only the nozzle or nozzles 25 associated with the cavity or cavities 39 are clogged. In this case, the nozzle clogging can be removed by sucking ink from only the clogged nozzle or nozzles.

Figure 5:
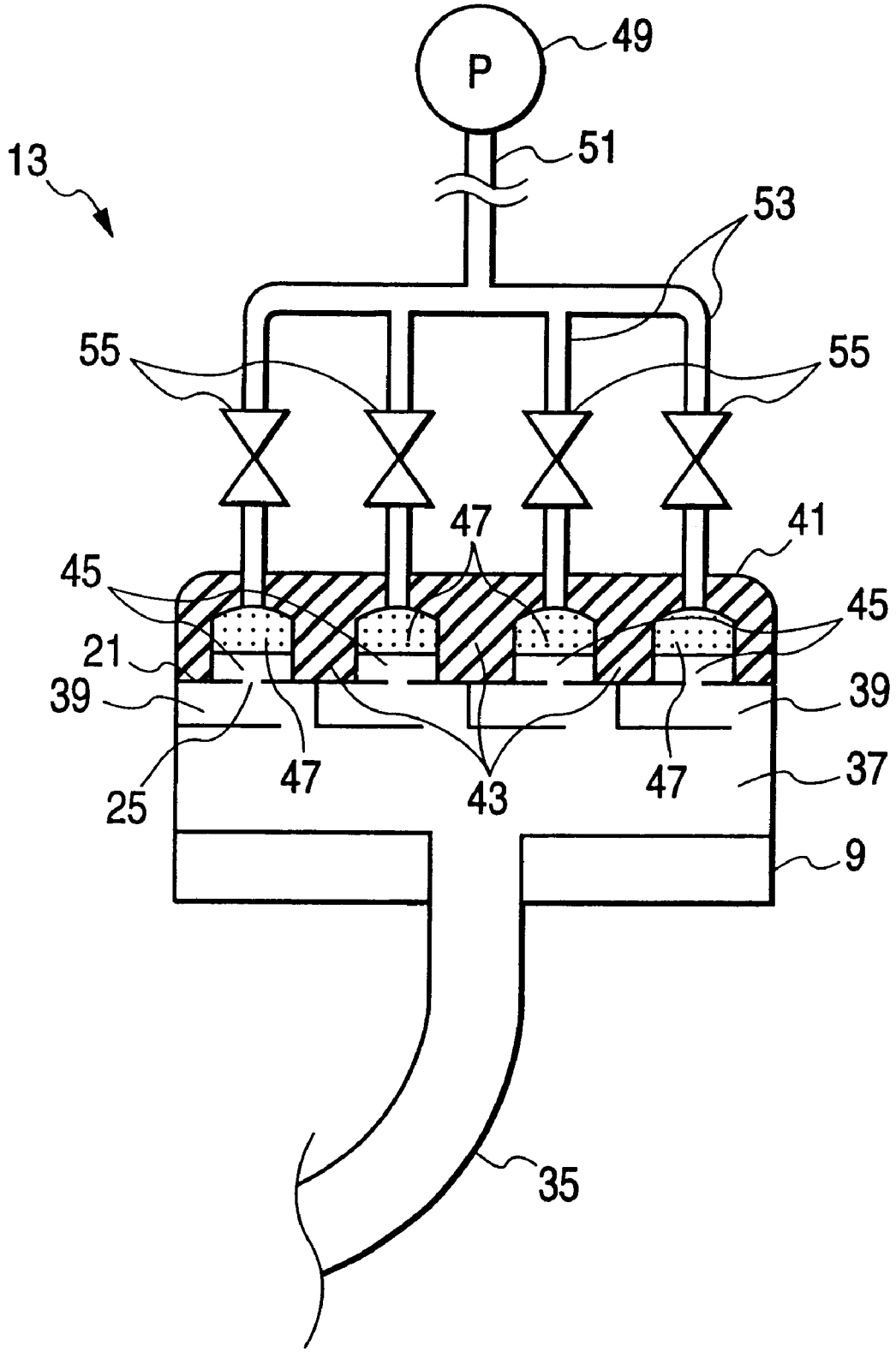
FIG. 5 is a cross sectional view, taken along line A—A in FIG. 3, showing a structure of a capping device.

FIG. 5 is a cross sectional view, taken along line A—A in FIG. 3, showing a structure, in particular for "suction", of a capping device 13.

The capping device 13 includes a rubber cap 41 as shown. The rubber cap 41 is applied to the print surface when the print head 9 is at a home position. Normally, a small negative pressure is applied from a suction pump 49 to the rubber cap 41 being applied to the print head 9, for the purpose of preventing the nozzles 25 from being dried. Under the small negative pressure, the peripheral edge of the rubber cap 41 is brought into close contact with the print surface of the print head to air-tightly seal the print surface. To perform a cleaning process, a large negative pressure is applied from the suction pump 49 to the rubber cap 41 being applied to the print head 9, to thereby suck ink from the nozzle or nozzles 25.

The rubber cap 41 includes three partitions 43 of rubber. With those partitions, four small spaces or cavities 45 are formed in the rubber cap 41. Those small cavities 45 are narrow and long when viewed from the front, and sized so as to cover the four nozzle arrays 27-1 to 27-4 (FIG. 3). When the rubber cap 41 is applied to the print head 9 and receives a small negative pressure, the partitions 43 are also brought into close contact with the print surface of the print head, so that the small cavities 45 are isolated from one another. The small cavities 45 are connected respectively through suction pipes 53 to the suction pump 49. Valves 55, which are independently operable for its opening and closing, are coupled to the suction pipes 53, respectively. In a cleaning mode of the printer, those four valves 55 are selectively operated for its opening and closing to suck the ink from the corresponding nozzle arrays 27-1 to 27-4. To suck the ink from all the nozzles 25, the valves 55 are all opened. Sponge 47 is put into each of the small cavities 45 to absorb the ink running out of the nozzles 25.

The rubber cap 41 shown in FIG. 5 is provided for the large nozzle group of one ink color in the print head 9. In an actual printer, four rubber caps 41 are provided for the nozzle groups of four ink colors in similar fashion. In this case, those four rubber caps may be separated from one another or take an integral form. Provision of one suction pump 49 suffices for all the rubber caps.

Figure 6:
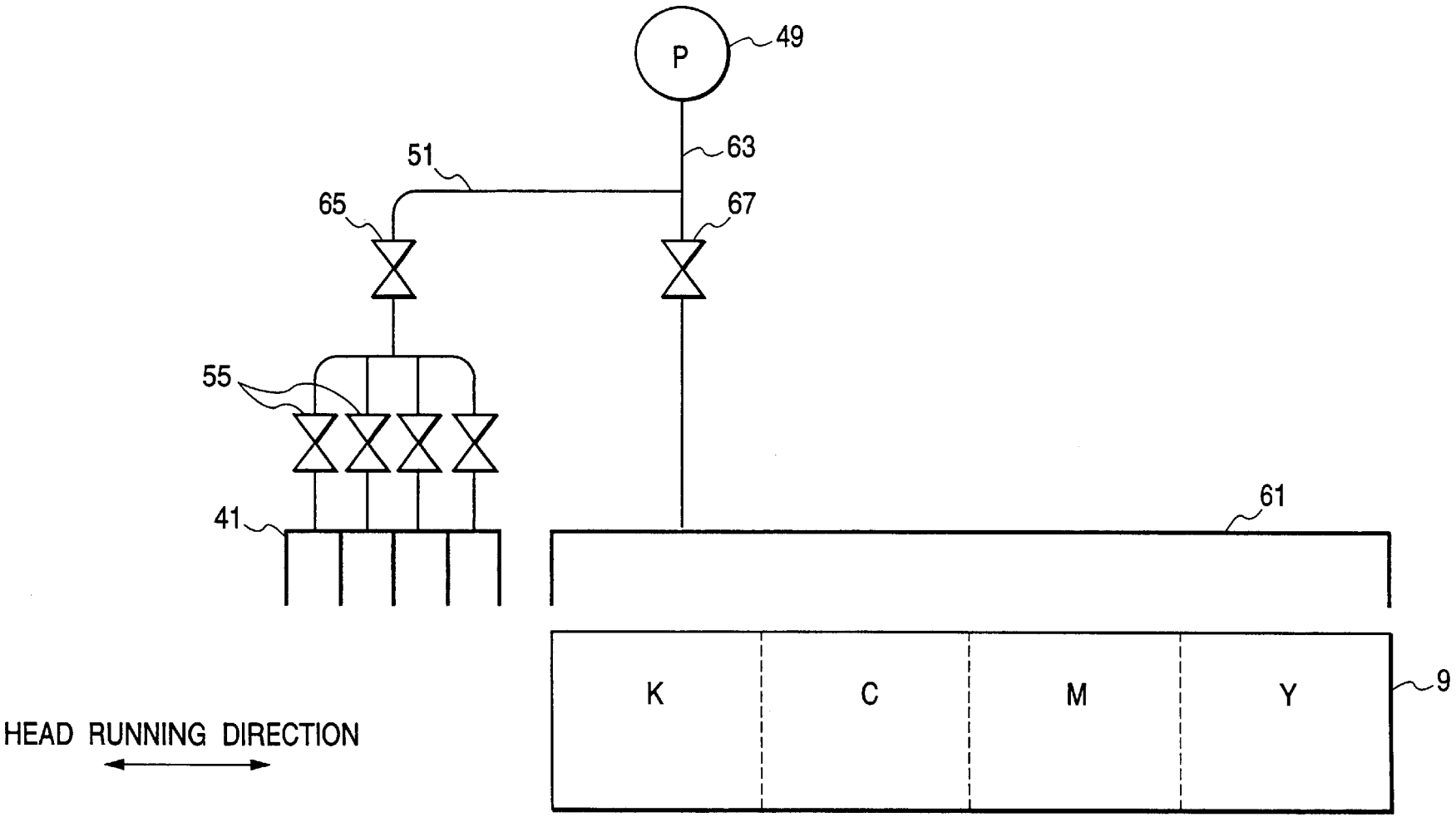
FIG. 6 is a diagram showing a modification of the capping device.

FIG. 6 is a diagram showing a modification of the capping device 13. The capping device has the combination of 1) a conventional rubber cap 61 capable of sucking the inks from all the nozzles at a stretch and 2) a rubber cap 41 capable of sucking the ink from the nozzles every nozzle array unit (nozzle group unit) of one ink color as shown in FIG. 5. The two rubber caps 41 and 61 are arranged in the running direction of the print head 9. Therefore, the rubber cap 41 or 61 can be selected and applied to the print head 9 by moving the print head. The rubber caps 41 and 61 are connected respectively through suction pipes 51 and 63 to a suction pump 49. Those suction pipes are respectively coupled to valves 65 and 67, independently operable. The capping device of this modification may be used in such a manner that the rubber cap 61 is used for the purposes of preventing the nozzles from being dried and of sucking all the nozzles, and the rubber cap 41 is used for the purpose of sucking the nozzles per unit of nozzle array, that is, unit of nozzle group. The rubber cap 41 is designed so as to cover only the nozzle groups (nozzle arrays) of one ink color. Because of this, where the nozzle-array basis (nozzle-group basis) suction is used, it is impossible to simultaneously suck the nozzles of a plural number of ink colors. However, this incapability feature does not create a problem in practical use because it is a rare case that the nozzles of a plural number of ink colors are simultaneously clogged, and in most cases, one or two nozzles of one ink color are clogged.

Figure 7:
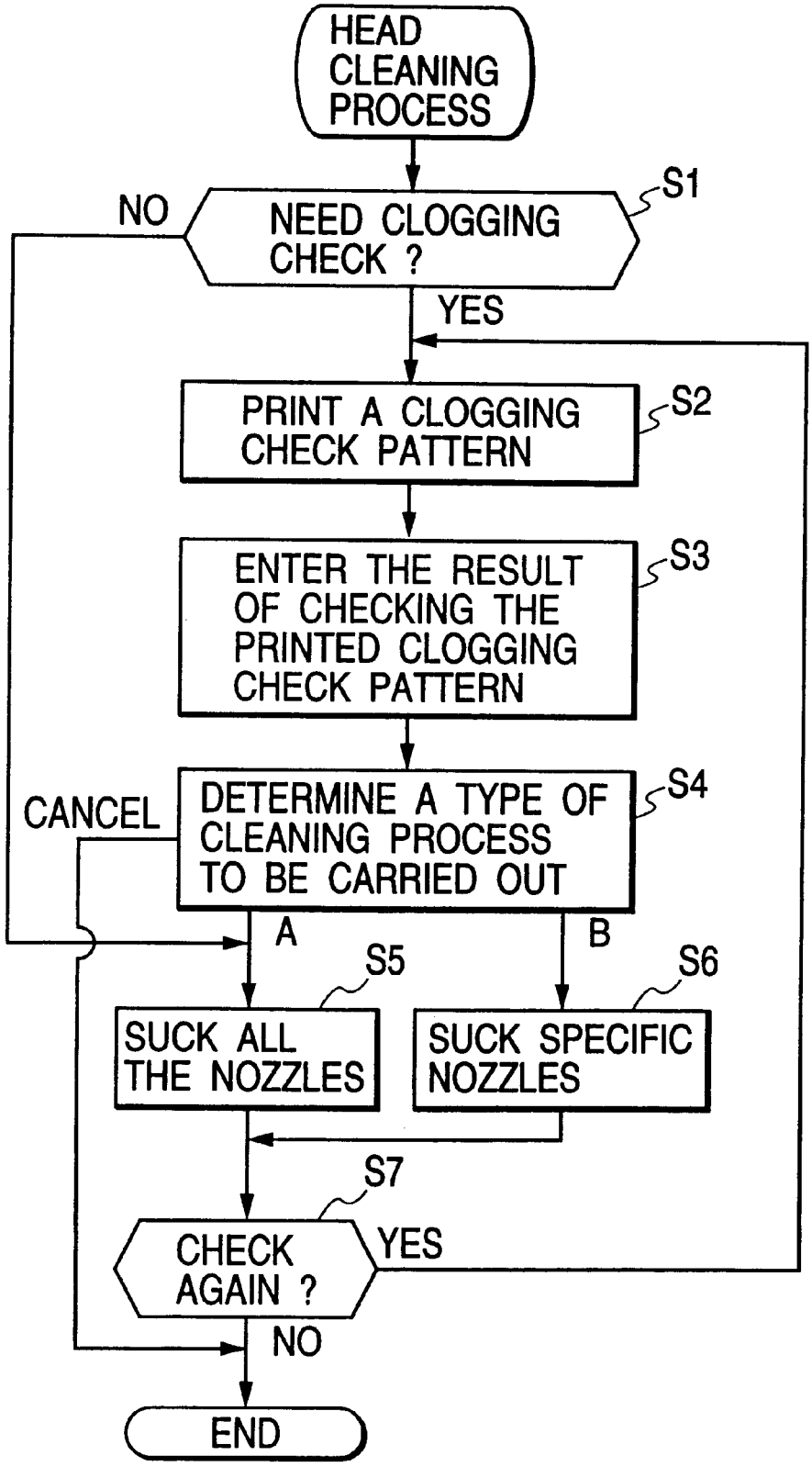
FIG. 7 is a flow chart showing a cleaning process performed by a printer driver.

FIG. 7 is a flow chart showing a cleaning process carried out by a printer driver 5. In the description given below, only the "suction" step of the cleaning process will be discussed, and the other steps of "flashing" "wiping" of the cleaning process will not be referred to, for simplicity.

A step S1 is first executed: the printer driver 5 questions the user as to whether or not a clogging check is performed.

If the user answers in the negative (does not need the clogging check), the printer driver 5 jumps to a step S5. In this step, the printer driver sends to the printer 3 a command that directs the printer to execute a conventional cleaning process for sucking all the nozzles. Upon receipt of the command, the printer 3, more exactly the controller 7 of the printer 3, moves the print head 9 to the home position; caps the print head 9 with the rubber cap 41 (FIG. 5); opens all the four valves 55; and drives the suction pump 49 to suck the inks from all the nozzles 25.

Figure 8A:
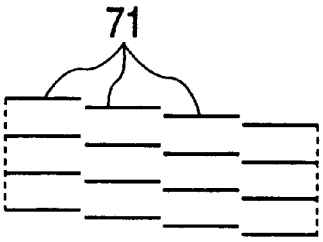
FIGS. 8A and 8B are diagrams showing an example of a clogging check pattern for one color.
Figure 8B:
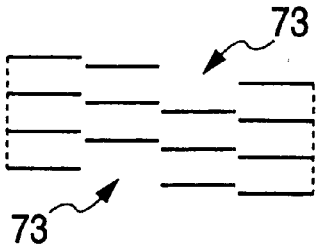

If the user answers in the affirmative (needs the clogging check), the printer driver 5, acting as a selection information generator sends to the printer 3 a command that directs the printer to print out a "clogging check pattern". In response to the command, the printer 3 prints out a clogging check pattern (step S2). The pattern printing is carried out such that the inks are jetted out from all the nozzles 25 of the print head 9 while moving the print head 9 a distance of the pitch d (several mm) between the nozzle arrays 27 (FIG. 3). The clogging check pattern consists of four sub-patterns of four colors K, C, M and Y arranged side by side (FIG. 8B). Each sub-pattern, as shown in FIG. 8A, consists of four groups of vertically arrayed horizontal short bars, those groups being arranged side by side in a state that the groups are stepwise lowered to the right (viewed in the drawing). In the sub-pattern of one ink color shown in FIG. 8A, 16 number of horizontal short bars are printed with 16 number of nozzles 25 of one ink color shown in FIG. 3. An example of the sub-pattern printed by the nozzle group including clogged nozzles is depicted in FIG. 8B. As shown, the locations 73 corresponding to the clogged nozzles are blank, viz., the short bars are not printed there.

Figure 9:
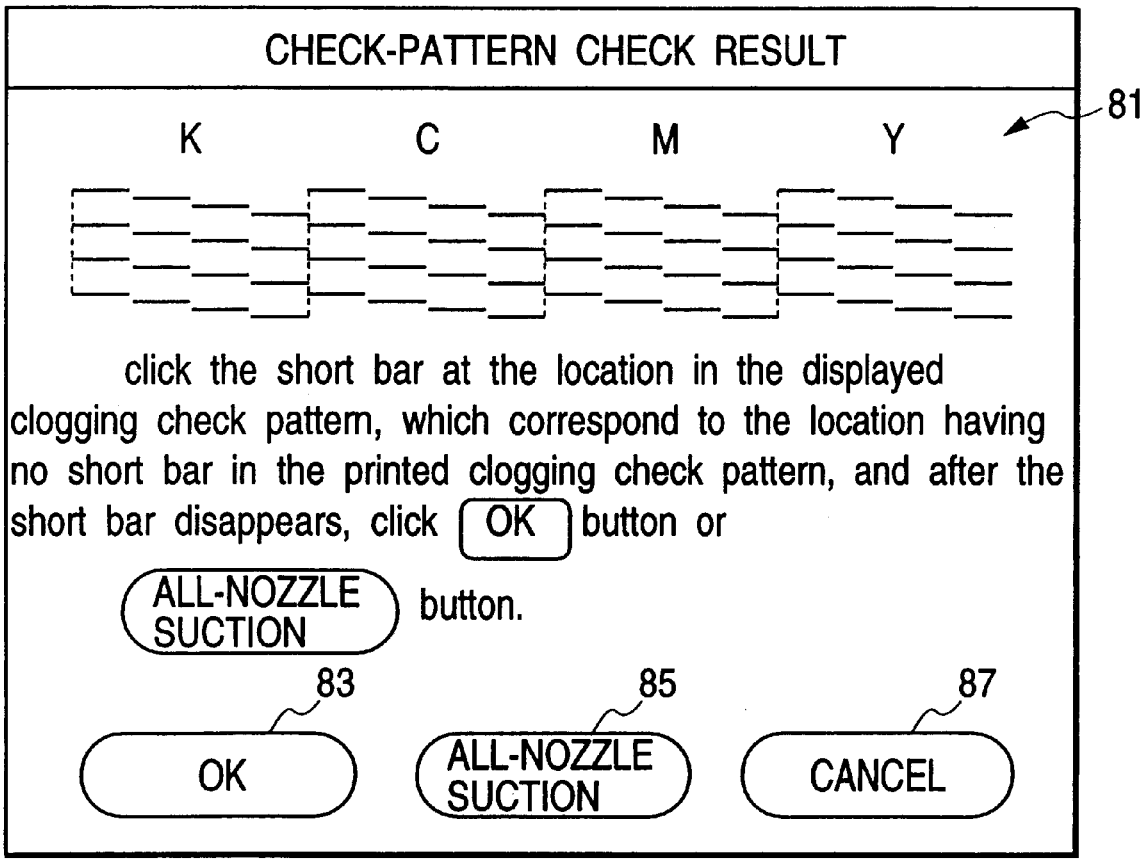
FIG. 9 is a diagram showing a clogging-check-result input screen.

After commanding the printer 3 to print such a clogging check pattern, the printer driver 5 visually presents a display screen used for inputting the result of checking a printed clogging check pattern, as shown in FIG. 9, and requests the user to enter the result of checking the printed clogging check pattern (step S3). As shown, the display screen of FIG. 9 includes a picture 81 of a clogging check pattern. When the user mouse-clicks the short bar in the picture 81 of a clogging check pattern, the clicked short bar disappears or changes its color. The number assigned to the clicked short bar is stored, as the clogged nozzle number, into the printer driver 5.

Accordingly, the user examines the printed clogging check pattern and clicks with the mouse the short bar at the location in the displayed clogging check pattern in the picture 81, to show the printer driver 5 the location of the clogged nozzle. The user mouse-clicks all the short bars at the locations in the displayed clogging check pattern, which correspond to the blank locations in the printed clogging check pattern, and mouse-clicks an "OK" button 83.

If the entering operations are troublesome, an "All-Nozzle Suction" button 85 may be clicked with the mouse. In the event that no clogged nozzle is found, a "cancel" button 87 may be clicked with the mouse.

When the "OK" button 83, "All-Nozzle Suction" button 85 or "cancel" button 87 is clicked, the printer driver 5 determines if the cleaning process is executed on the basis of the input result. If the cleaning process is executed, the printer driver 5 determines a type of cleaning (step S4). The cleaning consists of a conventional cleaning which sucks all the nozzles and a selective cleaning which sucks the nozzles of a specific nozzle array. When the "cancel" button 87 is clicked on the input screen of FIG. 9, the printer driver 5 recognizes that the cleaning process is not executed, and ends this process. When the "All-Nozzle Suction" button 85 is clicked, the printer driver 5 recognizes that the conventional cleaning is performed, and advances to the step S5.

When the "OK" button 83 is clicked, the printer driver 5 determines if the cleaning to be executed is of the conventional type or of the selective type, on the basis of the clogged nozzle number already stored. The logic used for the determining the type of cleaning is as shown in FIG. 10. In a case that only one clogged nozzle is contained in the nozzle group of one color (i.e., the nozzle group connected to one common ink chamber), or in another case that two clogged nozzles are contained and one of them is located relatively close to the center of the nozzle group (relatively close to the connection part of the feed pipe 35 and the reservoir 37 (FIG. 4) and hence its flow resistance is relatively small), the printer driver 5 determines that the cleaning to be executed is of the selective type in which a specific nozzle array to which the clogged nozzle belongs is sucked, and advances to a step S6. The reason for this is that in this case, the nozzle clogging is highly probably caused by the fact that air bubbles stay in the cavity 39 of the clogged nozzle. In a further case that three or larger number of clogged nozzles are contained in the nozzle group of one color or in an additional case that two clogged nozzles are contained in the nozzle group of one color and are both located relatively close to the end of the nozzle group (viz., their flow resistance is relatively large), the nozzle clogging is highly probably caused by the fact that air bubbles stay in the filter 33 and the feed pipe 35 (FIG. 4). For this reason, the printer driver 5 determines that the cleaning to be executed is of the conventional type or the all-nozzle suction type, and advances to the step S5.

In the step S5, as already described, the printer driver 5 sends a command for the conventional cleaning to the printer 3, and the printer executes the conventional cleaning process. In the step S6, the printer driver 5 sends to the printer 3 a command for the selective cleaning in which the nozzle array 27 containing the clogged nozzles is designated as an object to be sucked. In response to the command, the printer 3 moves the print head 9 to the home position; covers the print head 9 with the rubber cap 41; opens the valve 55 for the nozzle array 27 (one or two or larger number of nozzle arrays) as the object to be sucked, while closing the valves 55 for the remaining nozzle arrays 27; and sucks ink from only the nozzle array 27 as the object to be sucked. The above-mentioned measure taken for preventing air bubbles coming from the other nozzles (remaining nozzles) than the sucked nozzle from entering the sucked nozzle when the nozzles of the nozzle array to be sucked are sucked, is to merely close the valves for the remaining nozzles. An alternative measure is that the valve for the sucked nozzle is opened, and the valves for the remaining nozzles are opened with a preset time.

As described above, following the execution of the conventional or selective cleaning process, the printer driver 5 questions the user as to whether or not the clogging check is made again (step S7). If the answer to the question is YES (re-check of the clogging is made), the printer driver 5 returns to the step S2, and commands the printer 3 to print a clogging check pattern. In this case, the step S3 is executed to present the input screen of FIG. 9. An alternative is that after the clogging check pattern is printed for the recheck, the printer driver 5 presents a display screen as shown in FIG. 11, and questions the user simply as to whether or not the cleaning is made again. In this alternative, if the user clicks a "YES" button on the question screen of FIG. 11, the printer driver 5 advances to the step S5, and executes the conventional cleaning process again. If he clicks a "NO" button, the printer driver 5 ends this process.

It is evident that the present invention may be implemented into other various constructions and process than the specific ones described above.

In the above-mentioned embodiment, the print surface of the print head 9 has one sheet of head plate 91 as shown in FIG. 2. The invention may be applied to other print surfaces as shown in FIGS. 12A and 12B. In the example of FIG. 12A, the print surface has two head plates 91 and 93, one for black ink and the other for color inks. In the example of FIG. 12B, the print surface has four head plates 95 to 101 for the respective colors.

Figure 13:
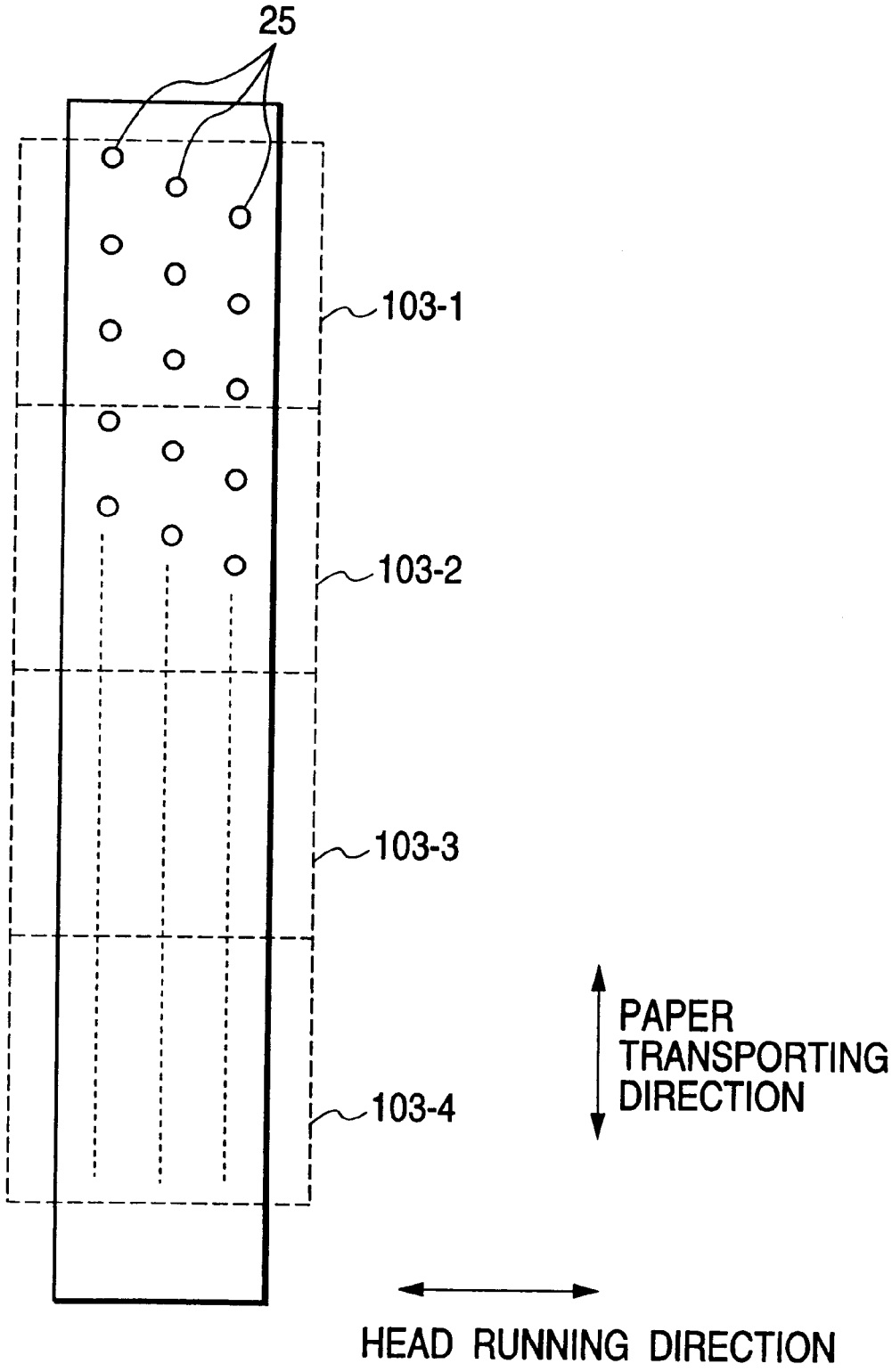
FIG. 13 is a diagram showing another way of grouping the nozzles.

In the above-mentioned embodiment, the discharge orifices formed in the print surface of the print head are grouped into orifice arrays (nozzle groups) 27-1 to 27-4 (FIG. 3). These orifice arrays are arranged side by side in the head running direction. The cleaning of those discharge orifices is performed every orifice array (the selective cleaning is used), that is, every nozzle group. An alternative is shown in FIG. 13. As shown, the discharge orifices formed in the print surface of the print head are grouped into nozzle groups (nozzle orifice arrays) 103-1 to 103-4. These nozzle groups 103 are arranged in the paper transporting direction. The cleaning of those discharge orifices is performed every nozzle group 103 (the selective cleaning is used). Another alternative is that the discharge orifices are grouped into orifice arrays every color, and the selective cleaning process is applied to those discharge orifices.

Figure 21A:
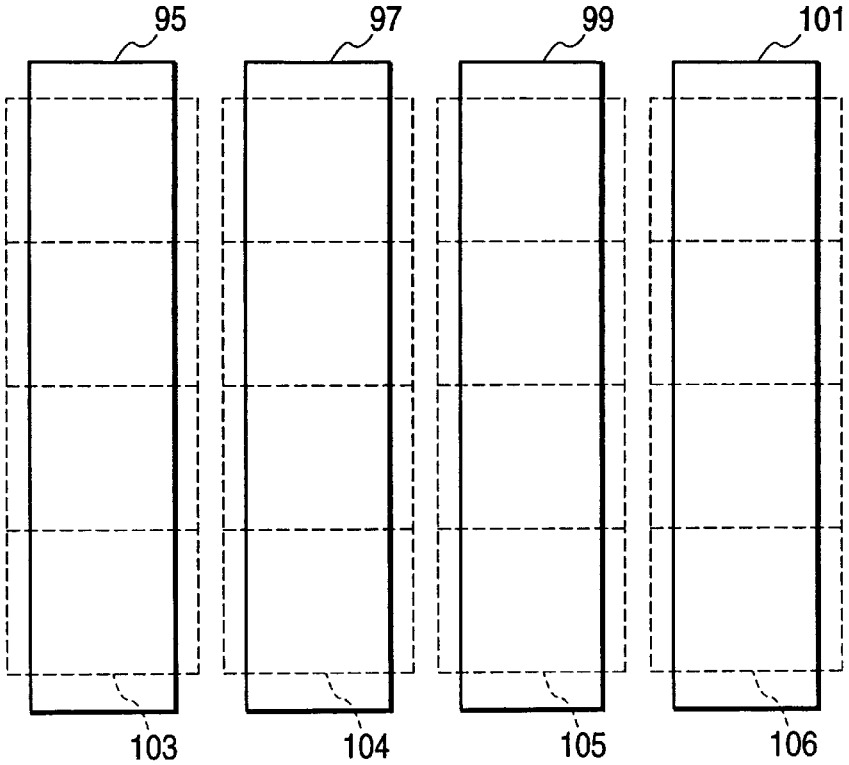
FIGS. 21A and 21B are diagrams showing a plurality of print heads each having way of grouping of the nozzles shown in FIG. 13.
Figure 21B:
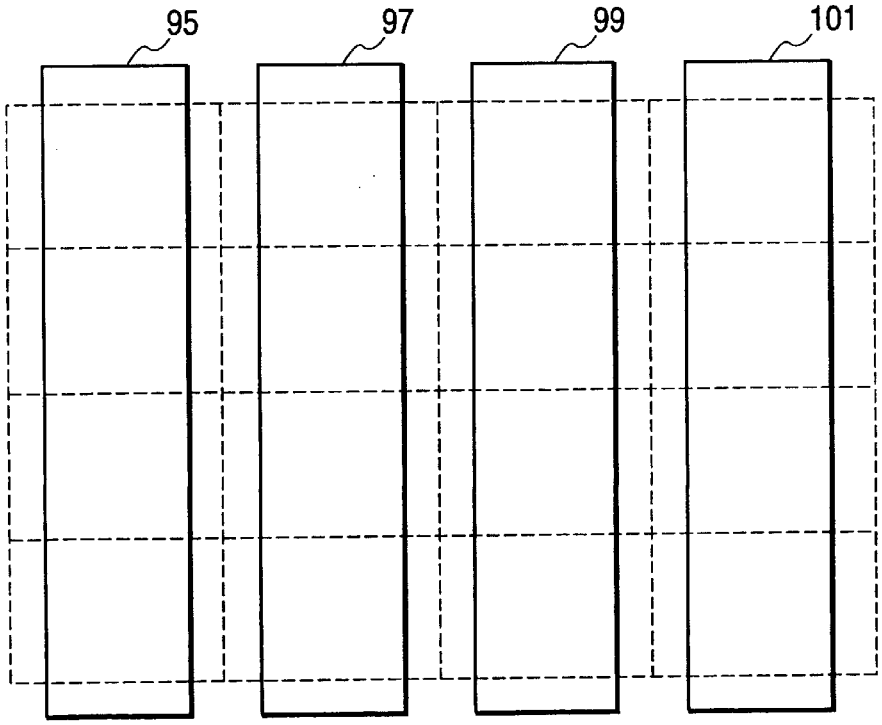

Further, a plurality of capping devices may be prepared in the printer according to the number of head plates 95 to 101 as shown in FIG. 21A. In FIG. 21A, each of capping devices has one cap rubber including four cavities. On the other hand, only one capping device may be prepared in the printer as shown in FIG. 21B. In FIG. 21B, the capping device has one cap rubber including sixteen cavities. Nozzle orifices 25 are omitted in FIGS. 21A and 21B for simplification of explanation.

The logic to determine the selective cleaning (step S4 in FIG. 7) may take any other suitable logic than the already mentioned one. An example of another simple logic is that the partial cleaning is applied to all the nozzle orifices of a nozzle orifice group containing clogged nozzles, irrespective of the location and the number of the clogged nozzles.

Further, the discharge orifices of the nozzles may be respectively covered with cavities formed in the rubber cap. To the cleaning, clogged nozzles are specified, and only the specified ones are subjected to the ink suction. The result is that the ink consumption by the cleaning is minimized.

Figure 14:
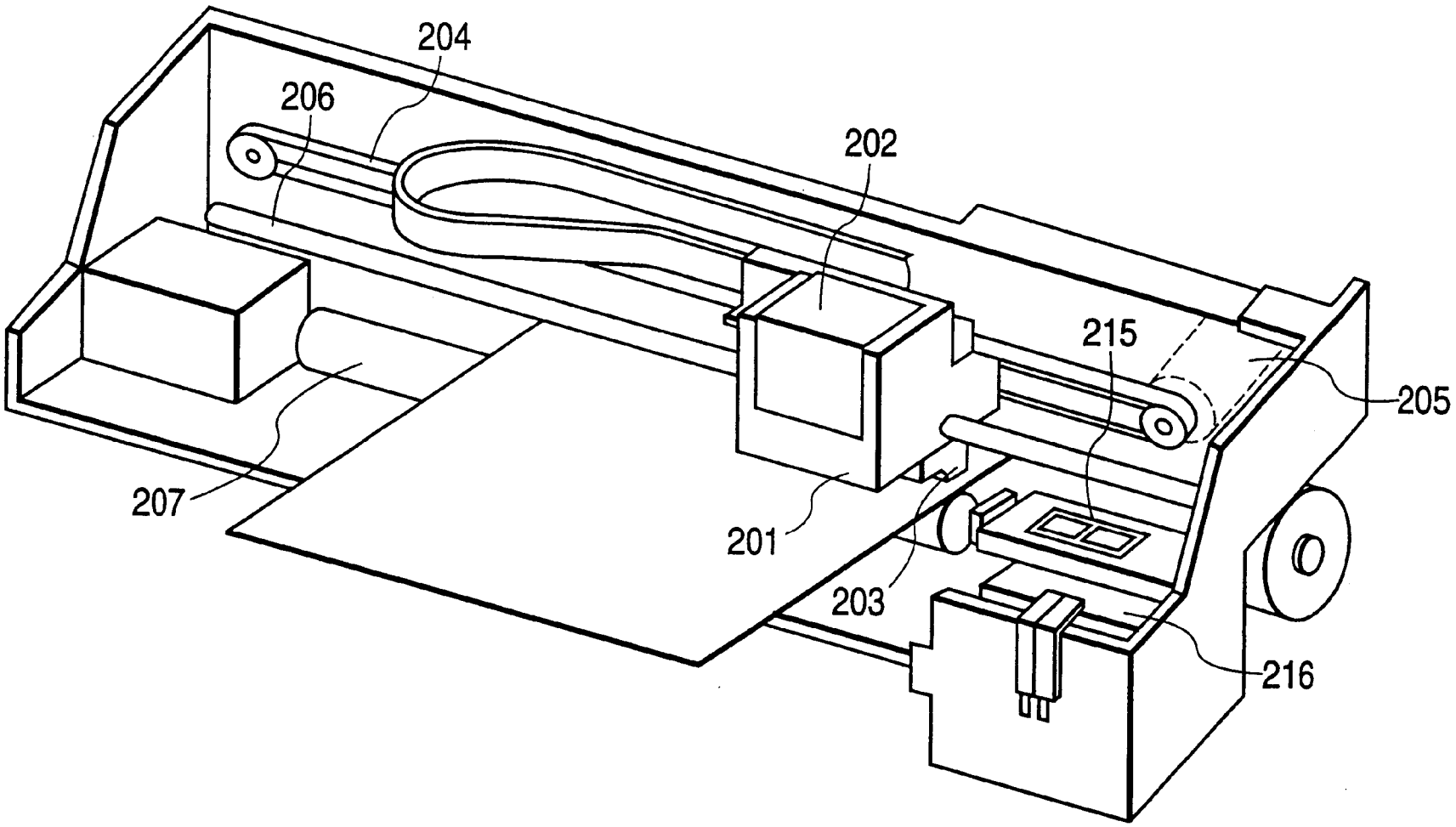
FIG. 14 is a perspective view showing a structure of an ink jet printer which is another embodiment of the present invention.

FIG. 14 is a perspective view showing a structure of an ink jet printer which is another embodiment of the present invention.

An ink tank (of the cartridge type) 202 is detachably attached to the upper side of a carriage 201. An ink jet print head 203 is fixedly attached to the lower side of the carriage 201. The carriage 201 is coupled with a motor 205 by a belt 204, and it is reciprocatively movable in the axial direction of a platen 207 while being guided by a guide rail 206.

Figure 15:
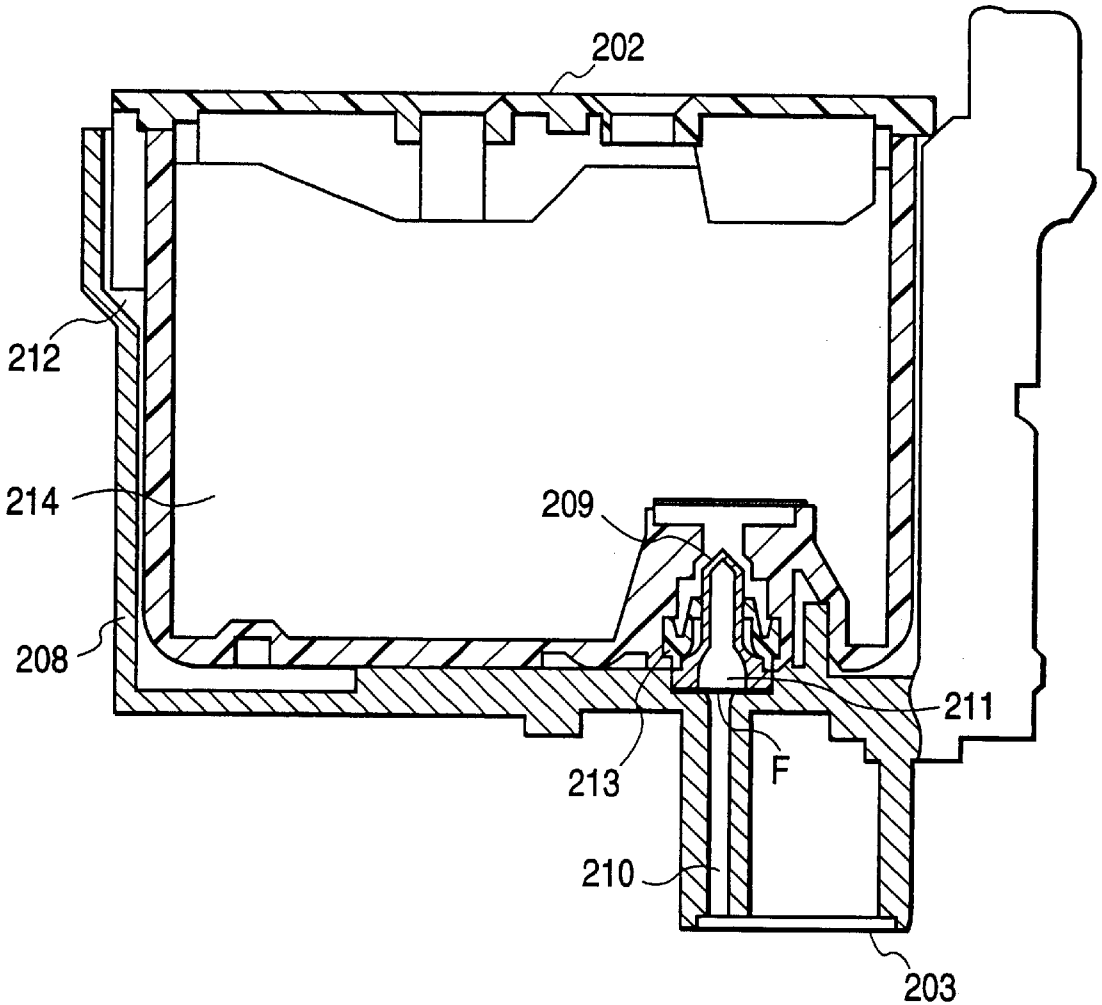
FIG. 15 is a cross sectional view showing a structure for mounting a print head and an ink tank on a carriage in the FIG. 14 printer.

FIG. 15 is a cross sectional view showing a structure for mounting the print head 203 and the ink tank 202 on to carriage 201 in the FIG. 14 printer.

A holder 208 for holding the ink tank 202 is fastened to the carriage 201. A print head 203 is fastened to the lower side of the bottom wall of the holder 208, while a needle tube 209 is secured to the upper side of the bottom wall. An ink supply passage 210 communicates the print head 203 with the needle tube 209. A filter chamber 211 is located between the needle tube 209 and the ink supply passage 210. The ink tank 202 is put in a tank receiving space 212 within the holder 208. When the ink tank 202 is put in the tank receiving space 212, the needle tube 209 thrusts into the ink tank 202, through an ink supply port 213, so that an ink chamber 214 communicates with the ink supply passage 210.

A capping device 215 is provided at the home position situated at the end of the traveling path of the carriage 201. The capping device 215 sealingly covers the print surface of the print head 203. The capping device 215 has at least three functions; a first function to prevent the nozzles from being dried, a second function to absorb ink discharged at the time of flushing, and a third function to expel ink from the ink jet nozzles by applying negative pressure to the nozzles from a suction pump 216.

Figure 16:
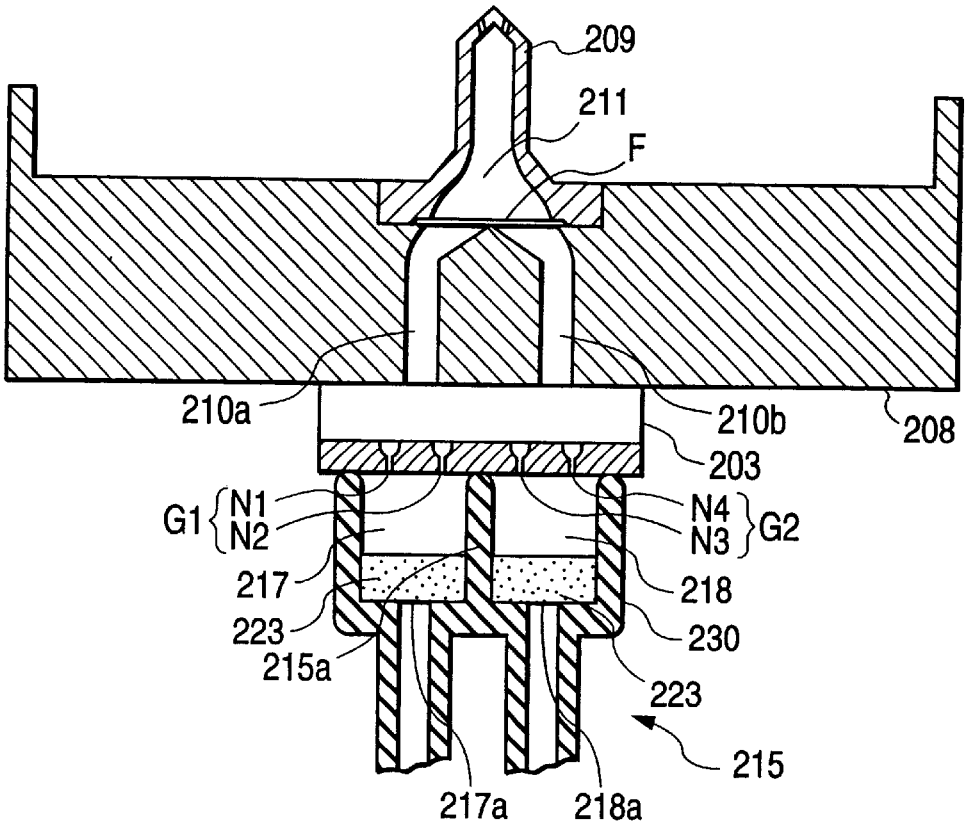
FIG. 16 is a cross sectional view showing an example of a capping device.
Figure 17:
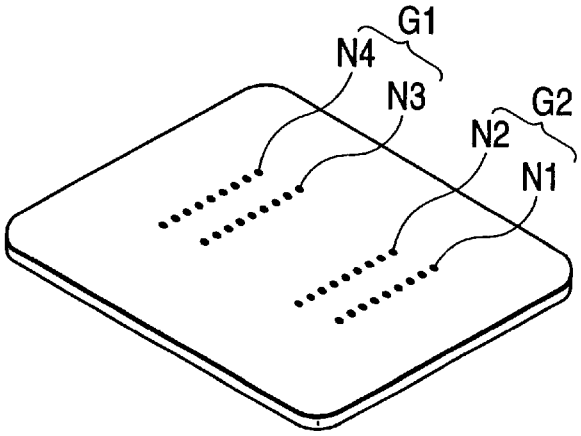
FIG. 17 is a perspective view showing a print surface of a print head to which the FIG. 16 capping device may be applied.

FIG. 16 shows an example of the capping device 215. FIG. 17 shows a print surface of a print head 203 to which the capping device 215 may be applied.

As shown, orifices are arranged into four linear orifice arrays N1 to N4 on the print surface of the print head 203. Those linear orifice arrays N1 to N4 are further arranged into two nozzle orifice groups G1 and G2. To supply ink from one needle tube 209 to the two nozzle groups G1 and G2, the ink supply passage 210 situated downstream of the filter chamber 211 is branched at the filter chamber 211 into two ink supply passages 210*a* and 210*b*. A filter F is provided within the filter chamber 211.

The capping device 215 includes a rubber cap 230 for sealingly covering the print surface of the print head 203. A partitioning wall 215*a* partitions a space within the rubber cap 230 into two cavities 217 and 218. Those two cavities 217 and 218 are capable of independently sealing the nozzle orifice groups G1 and G2 coupled respectively to the branch passages 210*a* and 210*b*. The cavities 217 and 218 have ink absorption ports 217*a* and 218*a*, respectively. Ink absorbing members 23 formed of porous material are put in the cavities 217 and 218.

Figure 18:
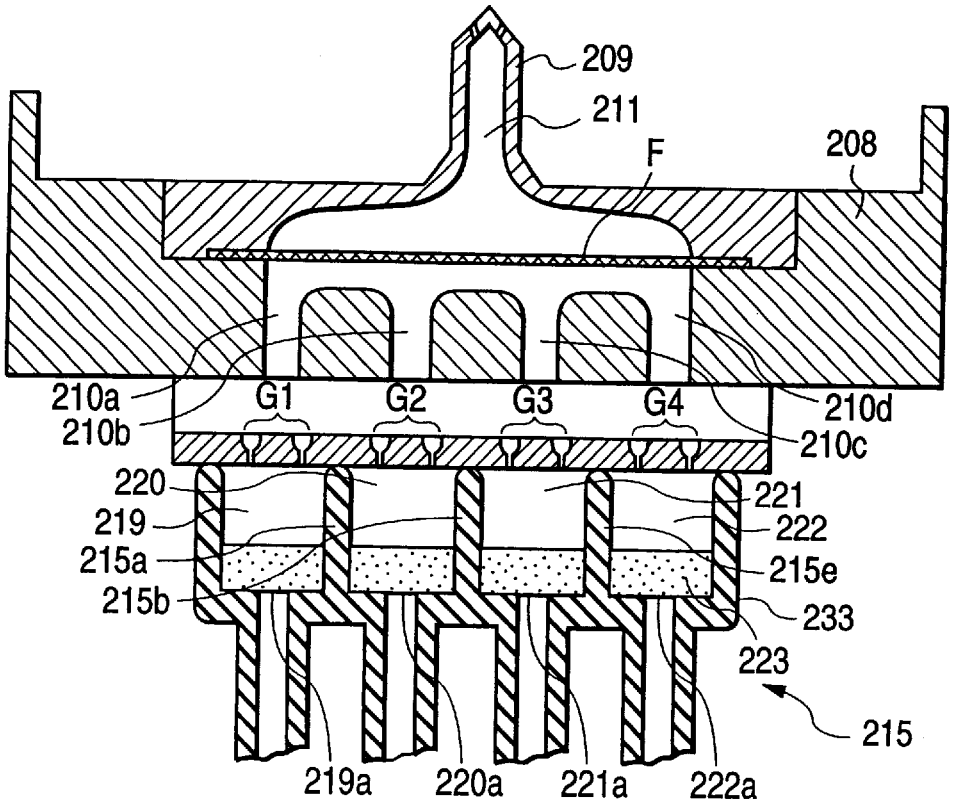
FIG. 18 is a cross sectional view showing another capping device.
Figure 19:
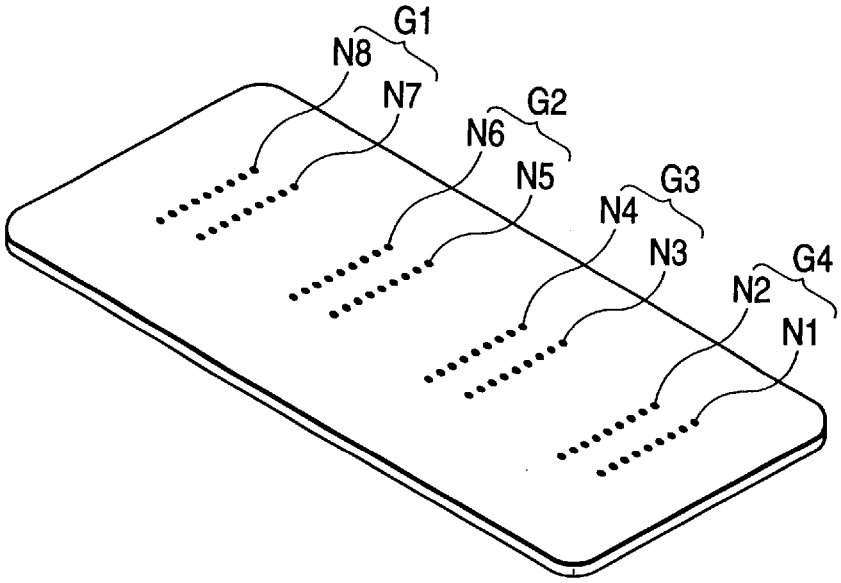
FIG. 19 is a perspective view showing a print surface of the print head to which the FIG. 18 capping device may be applied.

FIG. 18 is a cross sectional view showing another capping device 215. FIG. 19 is a perspective view showing a print surface of the print head 203 to which the capping device 215 may be applied.

As shown, orifices are arranged into four linear orifice arrays N1 to N8 on the print surface of the print head 203. Those linear orifice arrays N1 to N8 are further arranged into four nozzle orifice groups G1 and G4. To supply ink from one needle tube 209 to the two nozzle groups G1 and G4, the ink supply passage 210 situated downstream of the filter chamber 211 is branched at the filter chamber 211 into four ink supply passages 210*a* to 210*d*. A filter F is provided within the filter chamber 211.

The capping device 215 is provided with a rubber cap 233. A space within the rubber cap 233 is separated into four cavities 219 to 222 by partitioning walls 215*a* to 215*d*. Those four cavities 219 to 222 are capable of independently sealing the four nozzle orifice groups G1 to G4 coupled to the branch passages 210*a* to 210*d*. Those cavities have ink absorbing ports 219*a* to 221*a*, respectively. Ink absorbing members 223 formed of porous material are put in the chambers 219 to 222.

Figure 20A:
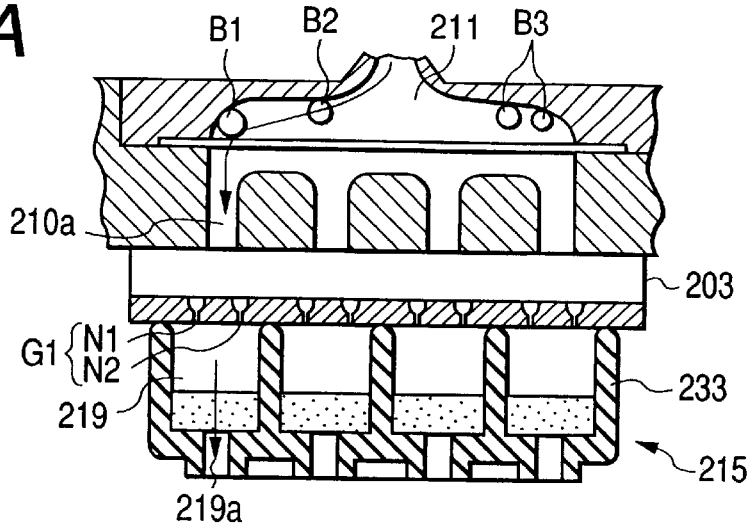
FIGS. 20A to 20C are cross sectional views for explaining the operations of the FIG. 18 capping device.
Figure 20B:
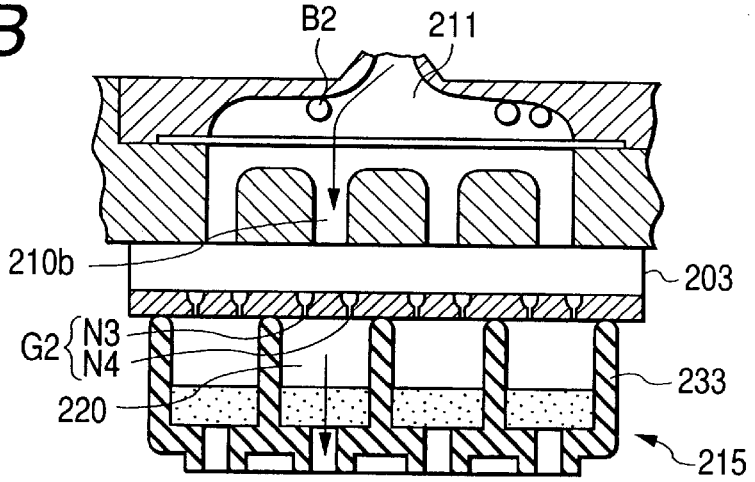
Figure 20C:
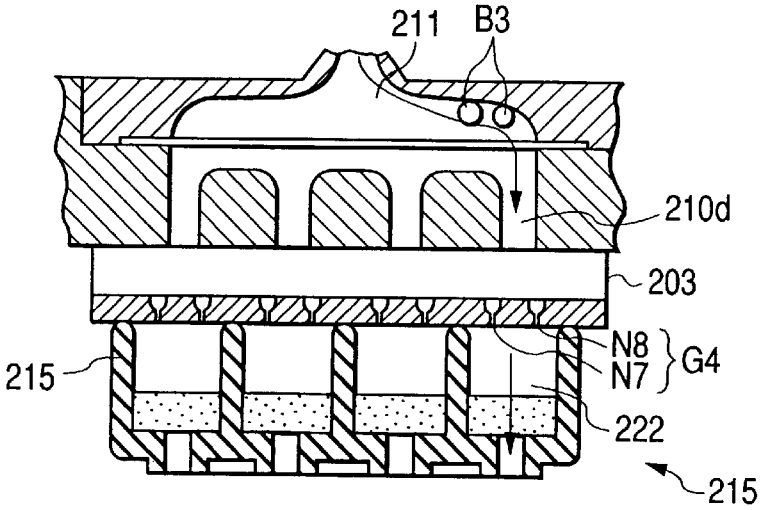

FIG. 20 is a cross sectional view for explaining the operation of the FIG. 18 capping device 215. The operation of the capping device 215 will be described hereunder.

In the case of a first loading or replacement of the ink tank 202, air is pressed into the needle tube 209 through a cylinder-piston action by the ink supply port 213 of the ink tank 202 and the needle tube 209. To discharge the air, the rubber cap 233 of the capping device 215 is applied to the print surface of the print head 203; negative pressure is applied to only the cavity 219 situated at the end of a train of cavities 219 to 222, through the ink absorbing port 219*a*; and the operation of sucking the first nozzle group G1 starts. In turn, as shown in FIG. 20A, ink flows from the filter chamber 211 into the branch passage 210*a*, and an air bubble B1 staying at a location near the branch passage 210*a* is moved to the print head 203. The air bubble having flowed into the print head 203, together with ink, is discharged to the cavities 219 of the rubber cap 233 through the nozzle group G1.

After the suction of the nozzle group G1 continues for a preset period of time, the supply of negative pressure to the cavity 219 is stopped. A negative pressure is supplied to the next cavity 220, and the operation of sucking the second nozzle group G2 commences. In turn, as shown in FIG. 20B, ink flows from the filter chamber 211 into the second branch passage 210*b*, and an air bubble B2 staying at a location near the branch passage 210*b* within the filter chamber 211 is moved to the second branch passage 210*b*, and discharged into the rubber cap 233 via the print head 203.

Following the suction for the second nozzle group G2, the suction for the third nozzle group G3 is performed (not shown), and finally the suction for the fourth nozzle group G4 is performed. In the final suction operation, negative pressure is applied to only the fourth cavity 222 of the rubber cap 233, and ink flows from the filter chamber 211 into the fourth branch passage 210*d*. Then, an air bubble B4 staying near the fourth cavity 222 within the filter chamber 211 goes to the fourth branch passage 210*d*, and discharged out via the print head 203.

Thus, negative pressure is sequentially supplied to the chambers of the capping device, so that quick flow of ink are sequentially created in the branch passages. With the ink quick flow, the air bubbles staying near the branch passages are individually and sequentially discharged, and as a result, the air bubbles within the whole filter chamber 211 are discharged.

While the preferred embodiments of the present invention have been described using specific terms, such description is for illustrative purposes only, and it should be understood that changes and variations may be made within the scope of the invention defined in the claims.

A process that a user locates a clogged nozzle by the utilization of a printed clogging check pattern, and specifies the clogged nozzle on a clogging check pattern on a display screen of the host computer in connection with the clogged nozzle located, which is applied to the ink jet printer in the embodiments mentioned above, may be applied to serial printers, such as wire impact dot printers and thermal transfer printers. In this case, the process is used for locating a defective dot forming element.

What is claimed is:

1. An ink jet printer comprising:

at least one ink chamber;

a print head having a plurality of ink jet nozzles and being connected to said at least one ink chamber, wherein at least some of the plurality of ink jet nozzles are associated with one of said at least one ink chamber; and a capping device comprising:

a first cap component having a plurality of cavities which sort said ink jet nozzles of said ink jet head that are associated with one of said at least one ink chamber into a plurality of nozzle groups and capping ink jet nozzles in said nozzle groups;

a second component for covering all ink jet nozzles in said print head concurrently; and a suction controller for controlling supply of negative pressure to said capping device;

wherein, (i) when said suction controller receives information designating at least one specific nozzle group, said suction controller applies negative pressure to said specific nozzle group through said first cap component in accordance with said designating information, and (ii) when said suction controller receives information designating all said nozzle groups, said suction controller applies negative pressure to all said nozzle groups through said second cap component.

2. An ink jet printer according to claim 1, wherein said suction controller applies negative pressure to one arbitrary cavity of said first cap component to suction the ink from said ink jet nozzles independently.

3. An ink jet printer according to claim 2, wherein said suction controller applies negative pressure to all said cavities of said first cap component.

4. An ink jet printer according to claim 1, wherein a plurality of said nozzle groups are arranged in a head running direction.

5. An ink jet printer according to claim 4, wherein said cavities of said first cap component are arranged in the head running direction.

6. An ink jet printer according to claim 1, wherein said all cavities of said first cap component are integrally arranged in one unit.

7. An ink jet printer according to claim 1, wherein said first and second cap components are arranged along a head running direction.

* * * * *